US006044809A

United States Patent [19]

Till et al.

[11] Patent Number: 6,044,809

[45] Date of Patent: Apr. 4, 2000

[54] METHOD FOR CONTROLLING A VEHICLE ENGINE COOLANT FAN

[75] Inventors: Mary L. Till, Manchester, N.H.; Erik M. Widdifield, Indianapolis, Ind.

[73] Assignee: Cummins Engine Company, Inc., Columbus, Ind.

[21] Appl. No.: 09/004,587

[22] Filed: Jan. 8, 1998

[51] Int. Cl.[7] ..... F01P 7/02

[52] U.S. Cl. ..... 123/41.12

[58] Field of Search ..... 123/41.12

[56] References Cited

U.S. PATENT DOCUMENTS

| | | | |
|---|---|---|---|
| 4,062,329 | 12/1977 | Rio | 123/41.12 |
| 4,179,888 | 12/1979 | Goscenski, Jr. | 60/420 |
| 4,433,648 | 2/1984 | LeBlanc | 123/41.12 |
| 4,694,784 | 9/1987 | Hirano et al. | 123/41.12 |
| 5,117,898 | 6/1992 | Light et al. | 165/34 |
| 5,359,969 | 11/1994 | Dickrell et al. | 123/41.12 |
| 5,483,927 | 1/1996 | Letang et al. | 123/322 |

*Primary Examiner*—Noah P. Kamen

*Attorney, Agent, or Firm*—Woodard, Emhardt, Naughton, Moriarty & McNett Patent and Trademark Attorneys

[57] ABSTRACT

A method for controlling a vehicle engine coolant fan. Because operation of the engine coolant fan creates a power drain upon the engine, it is undesirable to operate the coolant fan when the engine is fueled. Conversely, a power drain upon the engine is desirable when an attempt is being made to slow the vehicle. Consequently, the present invention requests activation of the coolant fan whenever a power drain upon the engine is desirable. Not only is this desirable in order to slow the vehicle, but it also lowers the coolant temperature, thereby reducing the chance that the coolant fan will have to be operated in the future when such operation is undesirable.

2 Claims, 1 Drawing Sheet

METHOD FOR CONTROLLING A VEHICLE ENGINE COOLANT FAN

TECHNICAL FIELD OF THE INVENTION

The present invention generally relates to engine control systems and, more particularly, to a method for controlling a vehicle engine coolant fan.

BACKGROUND OF THE INVENTION

A typical water-cooled internal combustion engine includes a cooling system that continuously circulates a coolant through the engine in order to dissipate heat generated by the combustion process and by friction. Without such a cooling system, the engine would experience thermal expansion of its moving parts until the engine seized.

In order for the cooling system to function properly, heat carried away from the engine by the coolant must be dissipated to the environment. This is typically done by circulating the heated coolant through a radiator and causing air to flow over the radiator's surface. During periods of elevated coolant temperature, the airflow caused by any motion of the vehicle is augmented by the operation of an engine coolant fan, which forces an increased amount of air to be drawn over the radiator surface.

Because the engine coolant fan is powered by the engine, operation of the coolant fan is a power drain upon the engine. Consequently, any fueling provided to the engine must be increased when the coolant fan is operational in order to maintain the same vehicle speed. Operation of the coolant fan therefore reduces the engine's fuel economy.

There is therefore a need for a method for controlling an engine coolant fan such that any adverse impact on the vehicle's fuel economy is minimized. The present invention is directed toward meeting this need.

SUMMARY OF THE INVENTION

The present invention relates to a method for controlling a vehicle engine coolant fan. Because operation of the engine coolant fan creates a power drain upon the engine, it is undesirable to operate the coolant fan when the engine is fueled. Conversely, a power drain upon the engine is desirable when an attempt is being made to slow the vehicle. Consequently, the present invention requests activation of the coolant fan whenever a power drain upon the engine is desirable. Not only is this desirable in order to slow the vehicle, but it also lowers the coolant temperature, thereby reducing the chance that the coolant fan will have to be operated in the future when such operation is undesirable.

In one form of the invention, a method for controlling a vehicle engine coolant fan is disclosed, comprising the steps of: a) determining if the vehicle is in cruise control mode; b) determining if a current vehicle speed is greater than a cruise control set speed plus a predetermined delta; c) determining if the engine is unfueled; d) determining if a vehicle brake has been activated; e) determining if an engine temperature is greater than a first predetermined temperature; f) requesting activation of the engine coolant fan if the determinations of steps (a), (b), (c) and (e) are positive; and g) requesting activation of the engine coolant fan if the determinations of steps (a), (b), (d) and (e) are positive.

In another form of the invention a method for controlling a vehicle engine coolant fan is disclosed, comprising the steps of: a) determining if the engine is unfueled; b) determining if a vehicle brake has been activated; c) determining if an engine temperature is greater than a first predetermined temperature; d) requesting activation of the engine coolant fan if the determinations of steps (a) and (c) are positive; and e) requesting activation of the engine coolant fan if the determinations of steps (b) and (c) are positive.

In another form of the invention a method for controlling a vehicle engine coolant fan is disclosed, comprising the steps of: a) determining if the engine is unfueled; b) determining if an engine temperature is greater than a first predetermined temperature; and c) requesting activation of the engine coolant fan if the determinations of steps (a) and (b) are positive.

In another form of the invention a method for controlling a vehicle engine coolant fan is disclosed, comprising the steps of: a) determining if a vehicle brake has been activated; b) determining if an engine temperature is greater than a first predetermined temperature; and c) requesting activation of the engine coolant fan if the determinations of steps (a) and (b) are positive.

In another form of the invention a method for controlling a vehicle engine coolant fan is disclosed, comprising the steps of: a) determining if the engine is unfueled; b) requesting activation of the engine coolant fan if the determination of step (a) is positive.

In another form of the invention a method for controlling a vehicle engine coolant fan is disclosed, comprising the steps of: a) determining if a vehicle brake has been activated; and b) requesting activation of the engine coolant fan if the determination of step (a) is positive.

In another form of the invention a method for controlling a vehicle engine coolant fan is disclosed, comprising the steps of: a) determining if an additional power drain on the engine is desirable; and b) requesting activation of the engine coolant fan if the determination of step (a) is positive.

DETAILED DESCRIPTION OF THE PREFERRED EMBODIMENT

Figure 1:
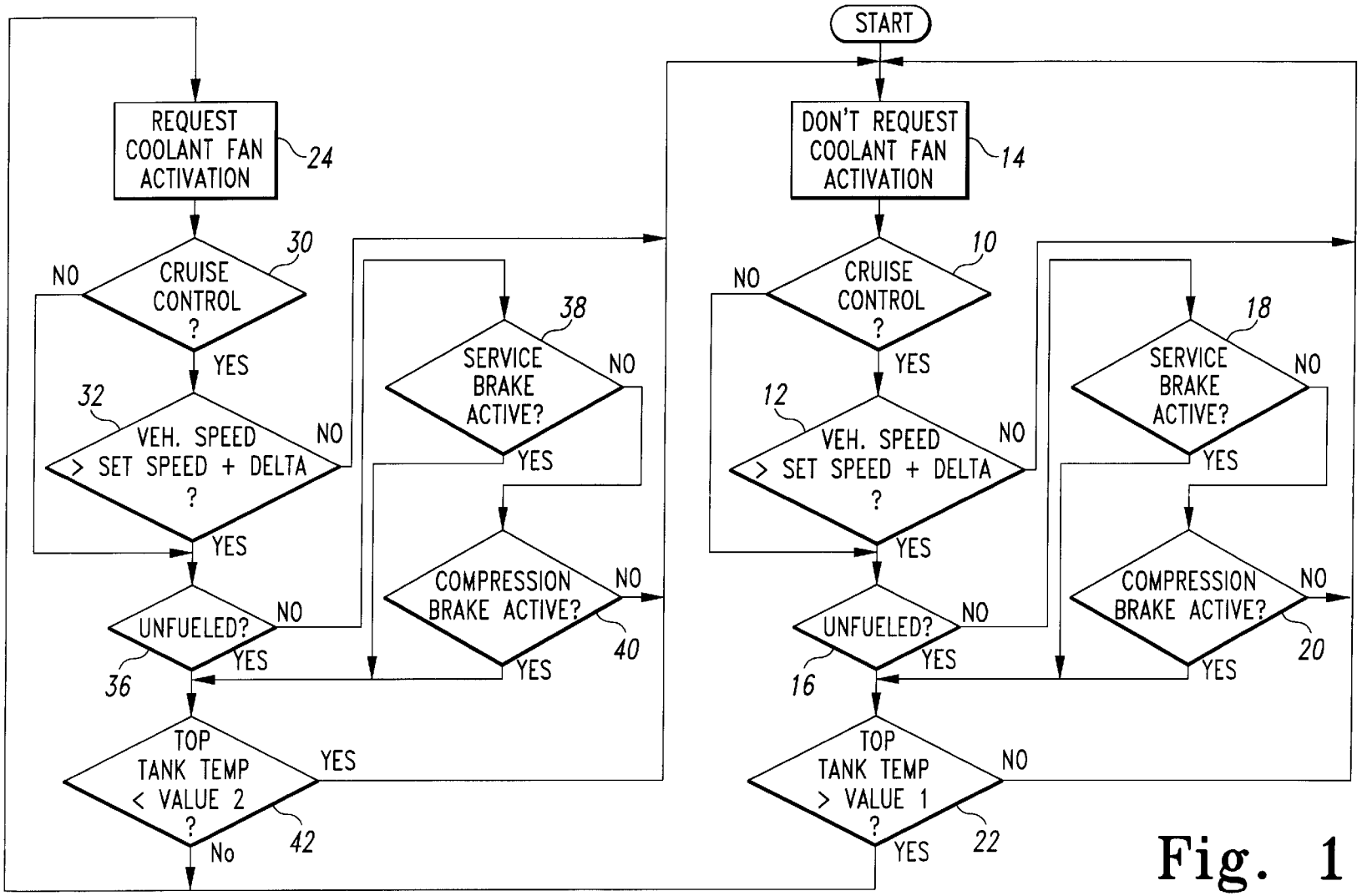
FIG. 1 is a schematic process flow diagram illustrating a first embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

The use of a vehicle's brake system to slow the vehicle results in high loads being placed upon the brake system, causing brake pad wear and the production of large amounts of heat. In the case of heavier vehicles, various types of auxiliary brakes are therefore used in addition to ordinary wheel brakes. Such auxiliary brakes (for example, an exhaust gas engine compression brake) allow for prolonged application of the auxiliary brakes without the vehicle's main brakes being used. As a result, the main brakes, which conventionally comprise friction brakes of the disc brake or drum brake type, are prevented from over-heating, thereby reducing the associated risk of brake failure. With the use of auxiliary brakes, increased operating safety is thus obtained in the braking system, since the auxiliary brakes may be used for constant speed keeping purposes and for moderate decelerations, while the vehicle's main brakes are saved for violent brakings provoked by unexpected disturbances in the traffic flow.

When a vehicle's speed is being maintained at a constant level, either by throttle commands from a driver or by means of a cruise control system, the occurrance of a downhill slope may cause the vehicle to undesirably accelerate. In such a situation, the driver or the cruise control system will attempt to reduce the amount of fuel delivered to the engine. When the engine is unfueled (motoring) and the vehicle continues to travel at a speed in excess of the desired speed, either the service brakes or the engine compression brakes must be activated in order to slow the vehicle to the desired speed.

The present invention takes advantage of the fact that it is desirable to create a power drain on the vehicle engine whenever the vehicle is in cruise control mode, the actual vehicle speed is greater than the set speed, and no fuel is being delivered to the engine. In such a situation, activating the engine coolant fan will created a desirable power drain which will slow the vehicle, and it will lower the temperature of the coolant. Similarly, the present invention provides for activation of the engine coolant fan during service brake or compression brake activation, thereby producing the same desirable effects. A further benefit is realized in that, because the engine coolant temperature is being reduced during the times that it is desirable to run the engine coolant fan (e.g. when it is desired to slow the vehicle), it is less likely that it will be necessary to activate the engine coolant fan during times when it would be undesirable to do so (e.g. during vehicle acceleration).

A preferred embodiment method for controlling an engine coolant fan according to the present invention is schematically illustrated in FIG. 1. The method of FIG. 1 begins in slate 14 where the process is not requesting activation of the engine coolant fan. The first condition determined by the method of FIG. 1 is whether the vehicle is in cruise control mode (step 10) and, if so, whether the vehicle speed is greater than the cruise control set speed plus a predetermined delta speed (step 12). In the present invention, the delta speed may be zero. If the vehicle is in cruise control mode but there is no vehicle overspeed condition, then the process moves to step 14 which ensures that the present process is not requesting coolant fan activation.

If on the other hand, the vehicle is in cruise control mode and the vehicle is experiencing an overspeed condition, the process continues to step 16. The process will also reach step 16 if the vehicle is not in cruise control mode at step 10. Step 16 determines whether the vehicle engine is in an unfueled condition. The process of FIG. 1 will only request coolant fan activation if the engine is in an unfueled condition or there is compression brake or service brake activity for longer than a predetermined time period.

Therefore, if step 16 determines that the engine is not unfueled, step 18 determines if there has been service brake activity for longer than a predetermined time period and step 20 similarly determines if there has been compression brake activity for longer than a predetermined time period. At least one of the conditions of steps 16–20 must be met in order for the process of FIG. 1 to continue. If none of these conditions are met, the process moves to step 14, which ensures that the process of the present invention is not requesting coolant fan activation.

If steps 16–20 determine that either the engine is unfueled or there has been brake activity for greater than the predetermined time period, step 22 determines if the top tank coolant temperature is greater than a predetermined value1. The process of FIG. 1 will request coolant fan activation only if the top tank coolant temperature is greater than the limit value1. Therefore, if step 22 determines that the top tank temperature is not high enough, the process moves to step 14 which ensures that the process is not requesting coolant fan activation. If, on the other hand, the top tank temperature is greater than value1, the process of FIG. 1 requests activation of the coolant fan at step 24.

The request for coolant fan activation at step 24 will remain active until one of the following conditions occurs:

1. The top tank coolant temperature falls below a predetermined value2, or
2. the vehicle compression brakes and service brakes have been deactivated and vehicle is currently being fueled.
3. The vehicle is not in a cruise control overspeed condition if currently in cruise control mode.

These conditions are determined at steps 30–42. The process first determines whether the vehicle is in cruise control mode (step 30) and, if so, whether the vehicle speed is greater than the cruise control set speed plus a predetermined delta speed (step 32). In the present invention, the delta speed may be zero. If the vehicle is in cruise control mode but there is no vehicle overspeed condition, then the process moves to step 14 which cancels the request for coolant fan activation.

If, on the other hand, the vehicle is in cruise control mode and the vehicle is experiencing an overspeed condition, the process continues to step 36. The process will also reach step 36 if the vehicle is not in cruise control mode at step 30. Step 36 determines whether the vehicle engine is in an unfueled condition (zero percent throttle). If step 36 determines that the engine is not unfueled, step 38 determines if there has been service brake activity for longer than a predetermined time period and step 40 similarly determines if there has been compression brake activity for longer than a predetermined time period. At least one of the conditions of steps 36–40 must be met in order for the process of FIG. 1 to continue to request coolant fan activation. If none of these conditions are met, the process moves to step 14, which cancels the request for coolant fan activation.

If steps 36–40 determine that either the engine is unfueled or there has been brake activity for greater than the predetermined time period, step 42 determines if the top tank coolant temperature is less than a predetermined value2. The process of FIG. 1 will cancel the request for coolant fan activation if the top tank coolant temperature has fallen to less than the limit value2. Therefore, if step 42 determines that the top tank temperature is low enough, the process moves to step 14 which cancels the request for coolant fan activation. If, on the other hand, the top tank temperature is greater than value2, the process of FIG. 1 requests activation of the coolant fan at step 24.

It will be appreciated by those skilled in the art that the process of FIG. 1 is just one of many engine control processes which may request coolant fan activation. Consequently, the result of performing step 14 is not necessarily turning off the engine coolant fan. Step 14 ensures that the process of FIG. 1 is not requesting engine coolant fan activation, however the engine coolant fan will remain active if another engine function is requesting coolant fan activation. It will be further appreciated by those skilled in the art that the process of FIG. 1 is merely one embodiment of the general concept of the present invention that activation of the engine coolant fan should be requested during times when there is an indication that an extra power drain would be desirable so that the vehicle speed may be reduced. By activating the engine coolant fan in times of excess vehicle energy, the temperature of the engine coolant may be lowered even when that temperature is not high enough to cause coolant fan activation under normal circumstances. By further lowering the coolant temperature when it is desirable to activate the engine coolant fan, there will be less need to operate the engine coolant fan in the future during times when such operation would be an undesirable power drain on the vehicle engine (e.g. during vehicle acceleration).

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected. For example, the process of FIG. 1 may be modified to limit fan operation to only those occasions when all of the engine compression brakes are active and the top tank temperature requirements are met in order to reduce wear on the engine coolant fan clutch. Similarly, the process of FIG. 1 may be modified to not request coolant fan activation if the vehicle cab heater is active and the cab is not warm enough. In such a situation, it is undesirable to lower the coolant temperature, as this will decrease the effectiveness of the cab heater. Additionally, the process of the present invention may decide not to request coolant fan activation if the engine speed is greater than a predetermined value. Activation of the coolant fan at too high of an engine speed can cause unnecessary wear on the fan clutch. Furthermore, coolant fan activation may be requested when there is an unfueled condition or during braking, regardless of the temperature of the coolant. Other modifications will be readily apparent to those skilled in the art.

What is claimed is:

1. A method of controlling a vehicle engine coolant fan, comprising the steps of:

a) determining if a cruise control is deactivated;

b) if the cruise control is activated, determining if the vehicle speed exceeds a set speed plus a predetermined delta;

c) determining if either of (a) and (b) is positive;

d) determining if the engine is unfueled;

e) if the engine is fueled, determining if either a service brake or an engine compression brake is activated;

f) determining if either of (d) and (e) is positive;

g) determining if the top tank temperature exceeds a first predetermined temperature;

h) requesting activation of a coolant fan if the determinations of (c), (f), and (g) are each positive;

j) while requesting the activation of the coolant fan, repeating steps (a) through (f);

k) while requesting the activation of the coolant fan, determining if the top tank temperature is above a second predetermined temperature; and l) ceasing to request the activation of the coolant fan if the determinations of (c), (f), and (k) do not each remain positive.

2. The method of claim 1, wherein the first predetermined temperature is less than the second predetermined temperature.

* * * * *

UNITED STATES PATENT AND TRADEMARK OFFICE
CERTIFICATE OF CORRECTION

PATENT NO : 6,044,809

DATED : April 4, 2000

INVENTOR(S) : Mary L. Till et al.

It is certified that error appears in the above-identified patent and that said Letters Patent are hereby corrected as shown below:

In Column 3, line 20, please delete "created" and insert in lieu thereof --create--.

Signed and Sealed this

Tenth Day of April, 2001

*Attest:*

Nicholas P. Godici

NICHOLAS P. GODICI

*Attesting Officer*

*Acting Director of the United States Patent and Trademark Office*